United States Patent [19]
Doll et al.
[11] 4,208,955
[45] Jun. 24, 1980

[54] CONTAINER MANUFACTURING APPARATUS AND METHOD

[75] Inventors: Calvin K. Doll; Phillip A. Tyrrell, both of Kansas City, Mo.

[73] Assignee: Phillips Petroleum Company, Bartlesville, Okla.

[21] Appl. No.: 872,143

[22] Filed: Jan. 25, 1978

[51] Int. Cl.[2] ..... B31B 17/02
[52] U.S. Cl. ..... 93/44; 93/39.1 R
[58] Field of Search ..... 93/39.1 R, 39.2, 39.3, 93/44, 44.1 R, 39.1 P, 39 C, 55.1 R

[56] References Cited

U.S. PATENT DOCUMENTS

| | | | |
|---|---|---|---|
| 2,725,001 | 11/1955 | O'Neil | 93/39.2 |
| 3,063,347 | 11/1962 | Cummings | 93/39.3 |
| 3,103,857 | 9/1963 | Geisler et al. | 93/39.2 |
| 3,468,226 | 9/1969 | England et al. | 93/39.3 |
| 4,053,346 | 10/1977 | Amberg et al. | 93/39.1 R X |

*Primary Examiner*—James F. Coan

[57] ABSTRACT

A container manufacturing apparatus comprises an endless conveyor continuously movable along a defined path and which has mounted thereon a plurality of mandrels in spaced apart relation. A sidewall blank feeder sequentially feeds blanks to the mandrels before each respective mandrel moves into a wrapping station wherein the sidewall blank is wrapped about the respective mandrel. The mandrel having a wrapped sidewall then moves to a station for receiving a formed bottom closure member after which the bottom closure member and the sidewall carried by the respective mandrel are moved to a station for heating a portion of the bottom closure member and the sidewall blank. After passing through the heating station the mandrel carrying the sidewall blank and bottom closure member moves through a bottom crimping station wherein a portion of the bottom closure member is bonded to a portion of the sidewall blank to form a container. After passing through the crimping station, the mandrel carrying the container moves to a finishing station which is operable for finishing the open end of the container and then removing the container from the mandrel. A conveying means is also provided for carrying the finished container away from the finishing station. The stripped mandrel then returns to pick up a new sidewall blank.

32 Claims, 10 Drawing Figures

CONTAINER MANUFACTURING APPARATUS AND METHOD

The present invention relates to an apparatus for manufacturing containers. In a specific aspect the apparatus processes thermoplastic coated paperboard sidewall blanks and bottom closure blanks to form a container having a tubular sidewall and a bottom closure member closing one end of the sidewall. Many apparatuses are known in the art for manufacturing containers of this general type. Generally such apparatuses are of an intermittent type, i.e., those which require stopping of various components to accomplish various forming operations. Such intermittently operated apparatus is generally of a relatively slow speed and consequently low output rate. Also, such apparatus is subject to starting and stopping forces of large component parts and the apparatus itself must be large in size or weight and/or have shock absorbing means to reduce vibration caused by such forces.

It would therefore be advantageous to provide an apparatus for manufacturing containers which is continuous in operation, not requiring starting and stopping movements for various portions of the apparatus.

The type of apparatus disclosed in U.S. Pat. No. 2,726,583 is well adapted for manufacturing containers, however, such apparatus requires the repeated starting and stopping of one or more turrets during the container manufacturing process. An apparatus of this type can produce about 60 containers per minute while still maintaining container quality. However, such an apparatus does require the use of mechanisms for effecting indexing movement of the turret or turrets.

The present invention provides an improved container manufacturing apparatus which is designed for high speed production of finished containers of the generally tubular sidewall closed bottom type. The present invention is well adapted for producing containers of either a cylindrical type or of a tapered sidewall type such as those known in the art.

It is an object of this invention to provide an apparatus for manufacturing tubular containers from thermoplastic coated paperboard or the like with the apparatus being adapted for producing the containers at a high production rate. It is another object to provide an apparatus for producing containers which is of a continuous motion type minimizing the number of component parts which have stopping and starting motions. It is a further object to provide a container manufacturing apparatus which has a plurality of stations along a defined path and through which an endless conveyor moves a plurality of wrapping mandrels. It is a still further object to provide a container manufacturing apparatus which is well adapted for its intended use.

Other objects and advantages of the present invention will become apparent from the following detailed description taken in connection with the accompanying drawings wherein are set forth by way of illustration and example, certain embodiments of this invention.

Figure 1:
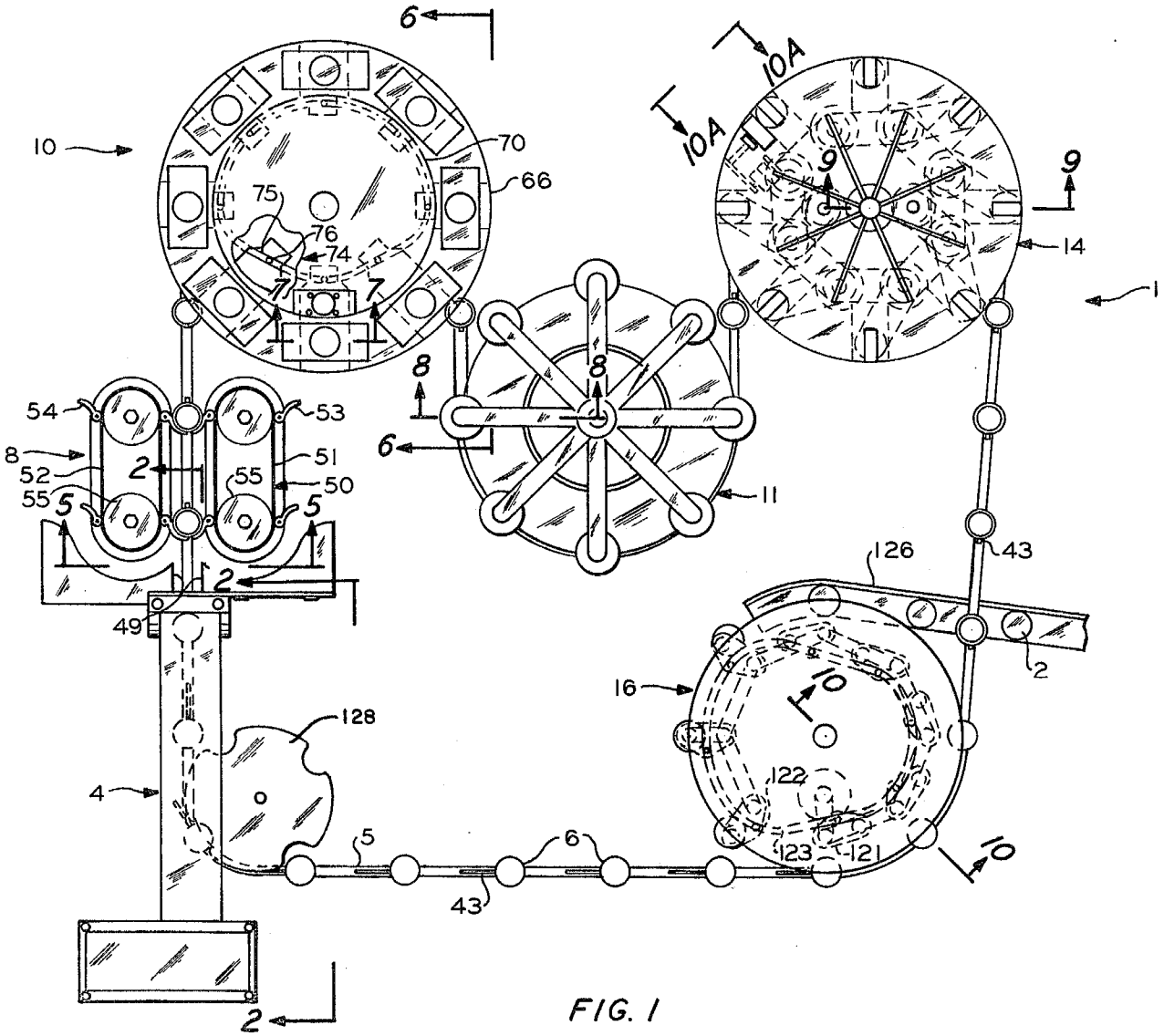
FIG. 1 is a plan view, shown partially schematically, of a container manufacturing apparatus.

The reference numeral 1 designates generally an apparatus for manufacturing containers 2 of the tubular sidewall type having a closed end. The apparatus 1 includes sidewall blank feeding means 4, positioned adjacent an endless conveyor 5 which has a plurality of mandrels 6 mounted thereon and movable along a defined path. Sidewall wrapping means 8 is also positioned adjacent the conveyor and is operable for wrapping a sidewall blank 9 about a mandrel and overlapping and bonding side marginal portions of the sidewall blank 9 to form a tubular sidewall 9'. Further along the conveyor 5 there is provided bottom closure member forming means 10 which is positioned adjacent the conveyor 5. The means 10 is operable for forming an end closure member from a blank and inserting the end closure member into one end of tubular sidewall carried by the mandrels 6. Further along the conveyor 5 there is provided heating means 11 adjacent the conveyor 5 and operable for heating a portion of the bottom closure member and a portion of the sidewall blank to facilitate securing of same together. A bottom crimping means 14 is provided along the conveyor 5 and is operable for urging the heated portions of the sidewall and bottom closure member into engagement for securing same together. If desired, there can be provided a container finishing means 16 operable for performing a finishing operation on the container.

The conveyor 5 preferably is of an endless type such as a pair of link chains 20 with brackets for supporting the mandrels 6 and is suitably mounted on supports 18 for movement along a defined path. Drive means 17 cooperates with the conveyor and is operable for effecting movement thereof. Preferably the drive means 17 includes a plurality of sprockets 19 which are operably connected to a motive means (not shown) such as an electric motor. Preferably, the conveyor 5 is comprised of a pair of spaced apart chains 20 with the chains 20 preferably being in superposed relation for a purpose to be later described. Such conveying chains 20 are well known in the art and need not be further described herein. It is to be noted, as best seen in FIG. 1, that the chains 20 travel in a circuitous path, preferably in a substantially horizontal plane.

Figure 2:
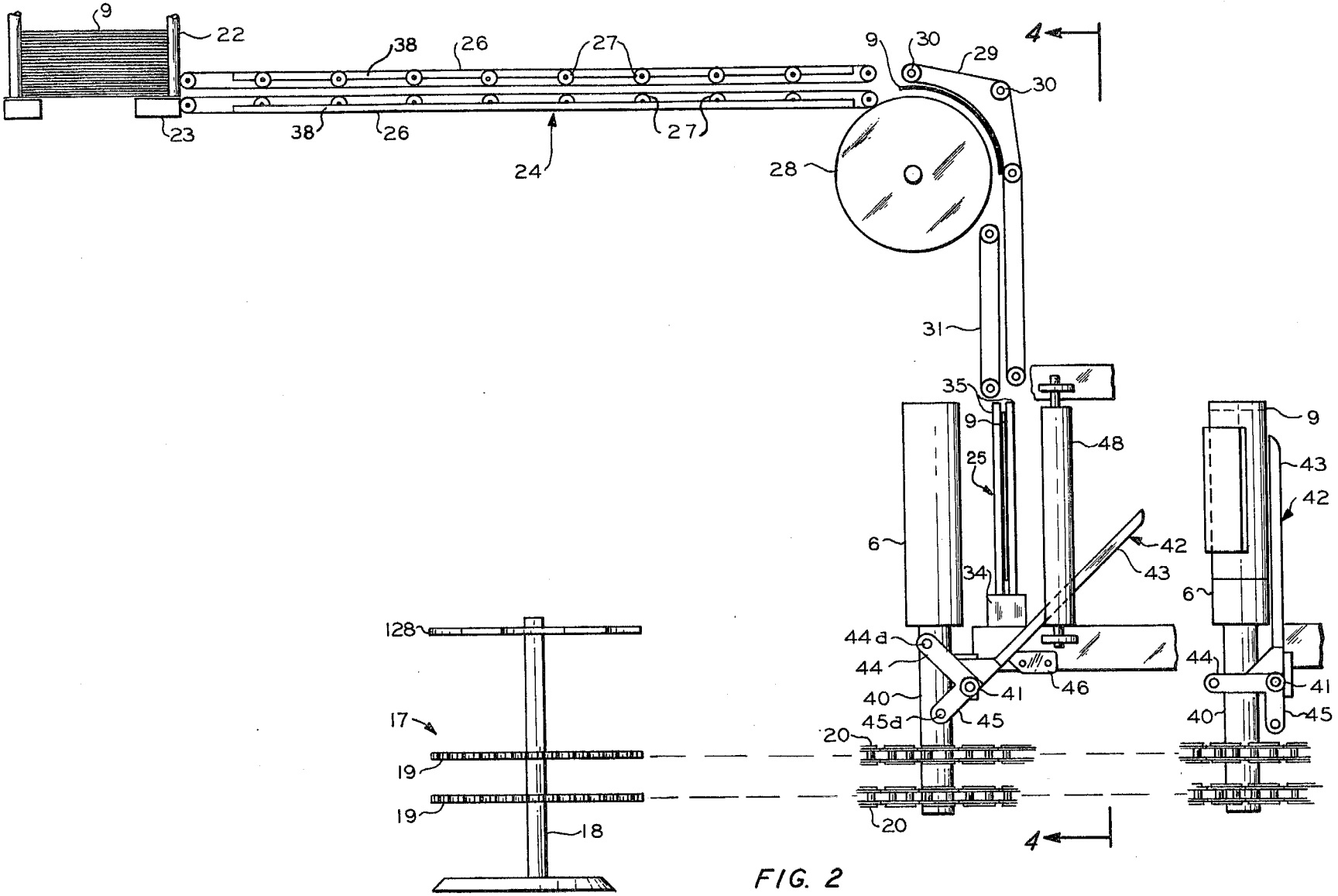
FIG. 2 is a fragmentary side elevational view, taken along the lines 2—2 of FIG. 1, showing the sidewall blank feed means.
Figure 3:
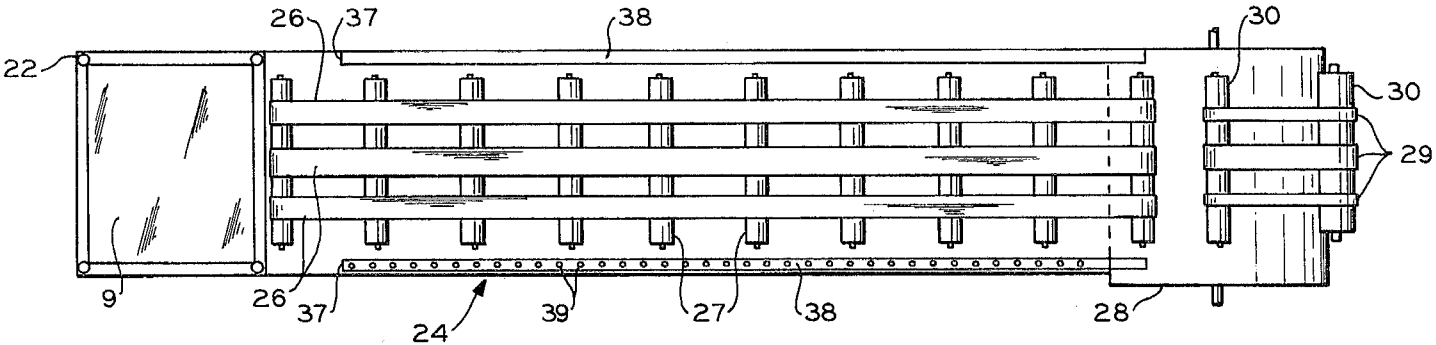
FIG. 3 is a plan view of a portion of the sidewall blank feed means of FIG. 2.
Figure 5:
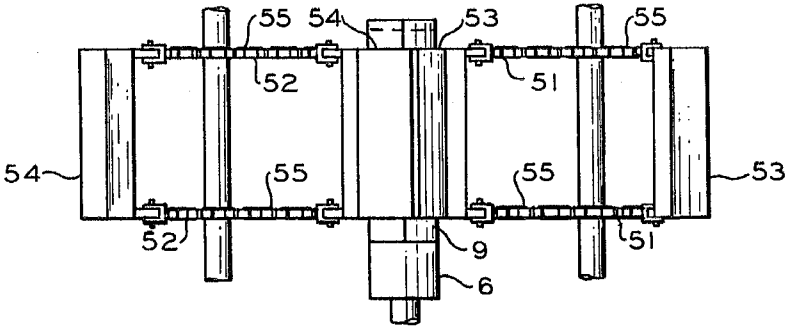
FIG. 5 is a fragmentary sectional view, taken along the line 5—5 in FIG. 1, of the sidewall wrapping means.

In the illustrated structure the sidewall blank feed means 4 includes a storage magazine 22, a blank feeder 23 and conveying means 24 operable for transporting individually fed sidewall blanks 9 from the magazine 22 along the conveyor 24 to a pickup station 25. As shown, the conveyor 24 comprises a plurality of driven endless belts 26 supported by rollers 27 with one belt 26 being positioned in spaced apart relation from another belt 26 wherein the fed sidewall blanks 9 are conveyed between two belts 26. This is best seen in FIGS. 2 and 3. After passing through the above described first portion of the conveyor 24, the sidewall blanks 9 are conveyed around a 90° bend by passing between a roller 28 and one or more driven belts 29 supported on rollers 30. This repositions the blanks 9 from a generally horizontal position to a generally vertical position. After passing around the corner, the blanks 9 are received by a second set of endless belts 31 positioned in spaced apart relation, which in mutual cooperation convey the sidewall blank 9 to the pickup station 25.

The pickup station 25 is best seen in FIG. 2 and includes stop members 34 and 35 against which opposite edges and one end of the fed blank 9 rest thereby retaining the blank 9 in the vertical position for pickup by the respective mandrel 6. Lateral shifting of the blank is prevented by first and second pairs of side stops 35, each pair being adjacent a respective side edge of the blanks so that the mandrels 6 can pass between the pairs of stops and through station 25.

In a preferred embodiment of the present invention heating means 37 is positioned adjacent the conveyor 24 and is operable for heating a thermoplastic coating, e.g., polyethylene coating, on side marginal portions of sidewall blanks 9 as they are conveyed along the conveyor 24. In the illustrated structure the heating means 37 includes a pair of heaters 38 positioned such that the side marginal portions of the sidewall blanks 9 pass thereover. As shown, each heater 38 is positioned adjacent a respective side of the conveyor 24 with one heater 38 being above and the other heater 38 being below a sidewall blank 9 being conveyed. This permits heating side marginal portions which will engage one another for subsequent securing together. The heaters 38 can be connected to a suitable source of heat such as a hot air source (not shown) or to a fuel supply such as natural gas. The hot air or combusting fuel exits through a plurality of orifices 39 so as to be in heating relation to the side marginal portions of the sidewall blank 9. The orifices 39 are spaced along the length of the respective heater 38 and can be equally or unequally spaced and can be all of substantially the same size or have varying sizes.

The mandrels 6 are of suitable shape and size for forming a desired container as, for example, the mandrel 6 can be substantially cylindrical or can be tapered to form generally cylindrical containers or tapered sidewall containers, respectively. The mandrels 6 are suitably mounted on the conveyor 5, for example, each mandrel 6 can be secured to a support 40 which in turn is secured in a suitable manner to each of the chains 20. By being secured to two chains, shifting or pivoting movement of the mandrel 6 is at least substantially eliminated thereby preventing lateral shifting of the mandrels 6. Preferably each of the mandrels 6 is provided with clamp means 42 which is operable for selectively holding a sidewall blank in engagement with the mandrels 6 so that the sidewall blank can be wrapped by the sidewall wrapping means 8. Any suitable clamp means can be provided and, in the illustrated structure, the clamp means 42 includes a clamp bar 43 pivotably mounted on the support 40.

Figure 4:
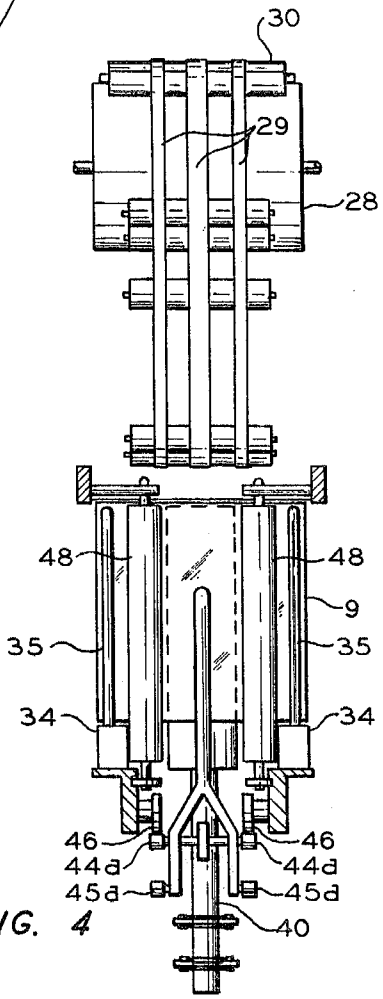
FIG. 4 is a fragmentary end view, taken along the line 4—4 of FIG. 2, of the sidewall blank feed means.

Means is provided for selectively pivoting the clamp bar 43 between a clamping position and a non-clamping position. The bar 43 is provided with two arm portions 44 and 45 with each having cam followers 44*a* and 45*a* mounted thereon as shown in FIG. 4. A cam 46 is mounted adjacent the pickup station and is operable for selective engagement with the cam followers 44*a* on the arm 44 to move the clamp bar 43 into a clamping position as the mandrel moves through the pickup station. The clamp bar 43 is held in the clamping position by a spring biased detent (not shown) on the pivot shaft 41 during movement through the wrapping station. The clamp bar 43 is moved to an unlatched position in a manner described below.

The sidewall wrapping means 8 is operable for wrapping the sidewall blank 9, picked up at the pickup station by a respective mandrel 6, about the respective mandrel 6 as the mandrel 6 moves continuously along the defined path. In the illustrated structure the sidewall wrapping means 8 includes a pair of rollers 48 or the like positioned on opposite sides of the defined path having the mandrels 6 moving therebetween. The rollers 48 are spaced apart a distance sufficient such that when a mandrel 6 carrying a sidewall blank 9 passes therebetween, folding of the sidewall blank about the mandrel is started. This is best seen in FIG. 4. Preferably the rollers 48 are positioned to wrap the sidewall blank 9 sufficiently to circumscribe approximately 180° of the mandrel. This is approximately 90° of the mandrel on each side of the clamp bar 43. Guides 49, as seen in FIG. 1, are positioned on opposite sides of the defined path having the mandrel 6 carrying a respective sidewall blank 9 pass therebetween. The guides 49 are operable for retaining the partially wrapped sidewall blank 9 in its partially wrapped condition as the mandrel 6 and respective sidewall blank 9 move along the defined path into another portion of the sidewall wrapping means 8.

The sidewall wrapping means 8 further includes wrapping wing means 50 operable for completing wrapping of the sidewall blanks 9. In a preferred embodiment of the present invention the wrapping wing means 50 includes a pair of endless conveyors or carriers 51 and 52 positioned on opposite sides of the defined path for having the mandrels 6 move therebetween. Each of the conveyors 51 and 52 has mounted thereon a plurality of wrapping wings 53 and 54, respectively. The movement of the conveyors 51 and 52 is such as to synchronize movement of the wings 53 and 54 with movement of the mandrels 6 along the defined path. To accomplish this, the conveyors 51 and 52 are mounted on respective pairs of drive sprockets 55, which are driven by the conveyor 5, so that the wrapping wings 53 and 54 move through arcuate path portions. The wings 53 and 54 move synchronously with the mandrel 6 thereby allowing continuous motion of the conveyor 5 and conveyors 51 and 52. The wrapping motion of the wings 53 and 54 is timed relative to the movement of the mandrels 6 along the defined path so that the heated side marginal portions of the sidewall blank 9 overlap for securement together. It is to be noted that the wings 54 are slightly longer in length, or extend slightly further around the mandrel 6 about which a sidewall blank 9 is being wrapped by the arms 53 and 54 so as to hold the overlapped side marginal portions, previously heated, in engagement until sufficiently cooled to effect the securement together. The wrapping wings 53 and 54 move along a portion of the defined path a sufficient distance to insure securement of the overlapping side marginal portions of the sidewall blanks 9 wrapped about the respective mandrels 6.

Figure 6:
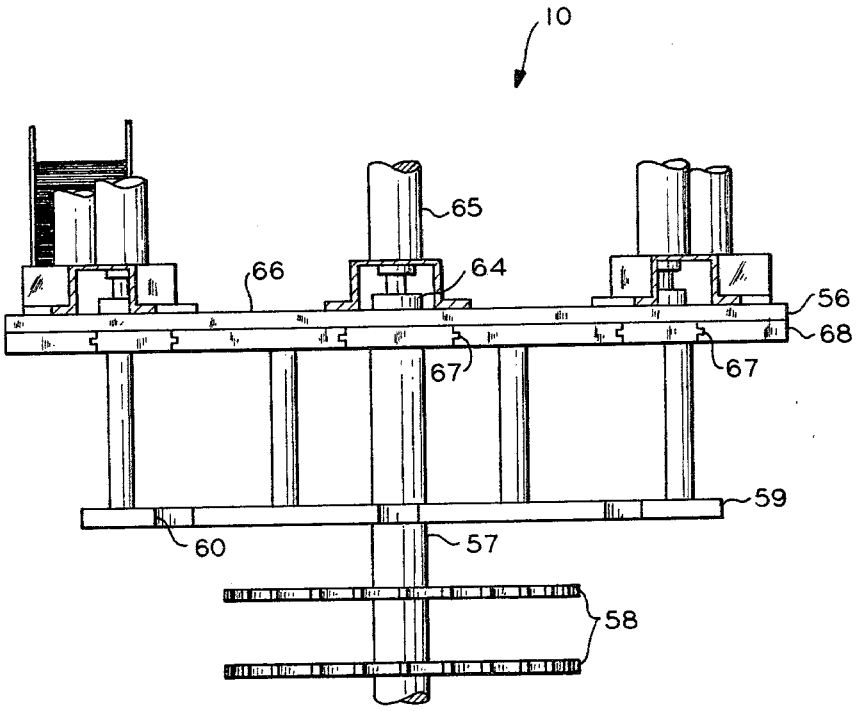
FIG. 6 is a fragmentary side elevational view, taken along the line 6—6 in FIG. 1, of the bottom forming means.

Further along the conveyor 5 is the bottom forming means 10. In a preferred embodiment of the present invention, the bottom forming means 10 includes a turret 56, as is best seen in FIG. 6. The turret 56 is mounted for rotation with a shaft 57 and has a portion of the conveyor 5 forming an arcuate path therearound. To synchronize movement of portions of the turret 56 with the movement of the conveyor 5 drive sprockets 58 are operably connected to the shaft 57 and are in driving engagement with the conveyor 5. Preferably, there are two sprockets 58 each in driving engagement with a respective chain 20. Indexing or positioning means is provided for precisely aligning the mandrel 6 with respective portions of the turret 56 for receiving an end closure 61. In the illustrated structure, the indexing means includes a star wheel 59 which has a plurality of notches 60 engageable with a portion of a respective mandrel 6 to insure alignment of the mandrel with portions of the turret 56 as later described.

Figure 7:
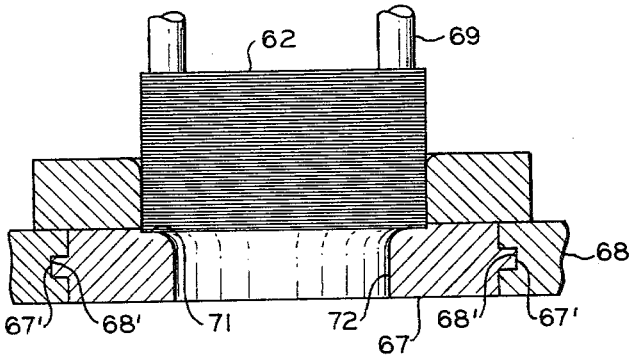
FIG. 7 is a fragmentary sectional view, taken along the line 7—7 in FIG. 1, of a portion of the bottom member forming means.

There is mounted on the turret 56 a plurality of means operable for forming a bottom or end closure member 61 from a bottom blank 62. In the illustrated structure a plunger 64 is mounted on a pneumatic ram 65 or the like with the ram 65 in turn being secured to a plate 66 which is rotatable with the shaft 57. A plurality of the rams and plungers are circumferentially spaced apart on the plate 66 equal distance in accordance with the spacing of the mandrels 6 on the conveyor 5. A plurality of forming dies 67 are mounted on a plate 68 preferably in a movable relation thereto preferably for reciprocal movement in a radial direction. As shown, a die 67 has tongues 67' on opposite sides thereof which are received in respective grooves 68' in the plate 68 so the die 67 can be reciprocally moved. The die 67 is best seen in FIG. 7. A magazine 69 is mounted on a third plate 70 which preferably is nonrotatable. The magazine 69 is adapted for storing a plurality of blanks 62 for individual dispensing into a respective die 67.

To individually feed a respective bottom blank 62 to a die 67 for forming a bottom closure member the dies 67 individually pass under the magazine 69 for receiving a bottom blank 62. The individual feeding is accomplished by having the die 67 provided with a recess 71 which has a depth of approximately the thickness of a bottom blank 62. By moving the die 67 under the magazine 69, a blank moves into the recess 71 by gravity. By moving the die 67 out from under the magazine 69, i.e., by outward radial movement, the die 67 moves into a forming position under a respective plunger 64. When in a position over a mandrel 6 having a wrapped sidewall blank 9 thereabout, the plunger 64 is then sequentially actuated for movement through a die opening 72. The plunger 64 forces the blank 62 through the opening 72 forming a bottom planar portion 77 and a depending skirt portion 78 on the bottom blank to form the closure member 61. By further movement of the plunger 64 through the opening 72, the closure member 61 is inserted into an open end of the sidewall 9 on its respective mandrel 6.

To effect the reciprocating movement of the die 67, cam means 74 is provided, as best seen in FIG. 1. The cam means 74, as illustrated, include a cam groove 75 which preferably is in the nonrotating plate 70. Each of the die plates 67 has a cam follower 76 received in the groove 75. The groove 75 is shaped such that the die 67 is moved radially inwardly under the magazine and after receipt of a bottom blank the groove 75 then urges the die 67 to move radially outwardly and over a respective mandrel 6.

Figure 8:
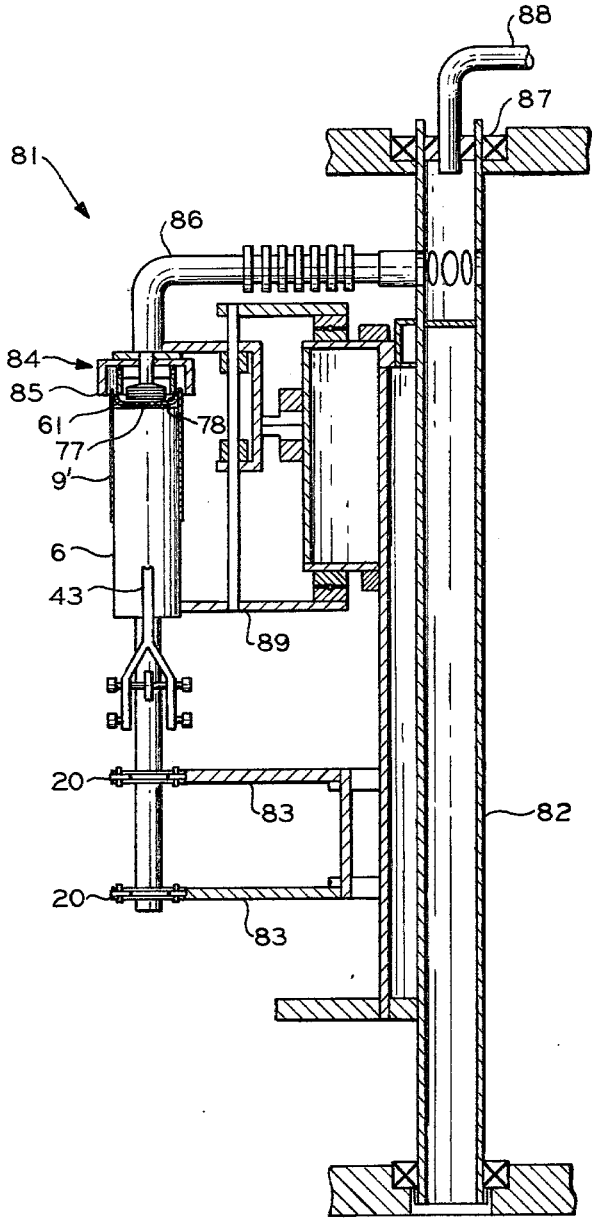
FIG. 8 is a fragmentary side elevational section view, taken along the line 8—8 in FIG. 1, of a portion of the heating means.

A preferred form of bottom heating means 11 is seen in detail in FIG. 8. In the illustrated structure the bottom heating means includes a turret 81 which is rotatable with a shaft 82 which preferably is operably connected to the conveyor 5 via a pair of sprockets 83 for synchronous movement. The bottom heating means 11 includes a plurality of heat applying means 84 mounted in circumferentially spaced apart relation on the turret 81. The heating means 84 can be of any suitable type and as illustrated include heating heads 85 which are connected to a suitable source of heat or can have heaters such as electrical resistance heaters installed therein. Preferably, the heating heads 85 are connected via respective conduits 86 to a source of hot air. This can be advantageously accomplished by having the conduits 86 connected to a rotary union 87 which in turn is operably connected via a conduit 88 to a source of hot air or the like (not shown). A portion of the shaft 82 can be hollow thereby providing a manifold for the conduits 86 to open into for communication with the union 87. The head 85 serves to direct heated air from the conduits 86 onto a skirt portion of the bottom closure member and an adjacent portion of the sidewall blank 9.

Rotation of the turret 81 is synchronized with movement of the mandrels 6 on the conveyor 5 and preferably indexing or positioning means is provided to assure accurate alignment of a heating head 85 with a respective mandrel 6. Any suitable indexing means can be provided and, as shown, a star wheel 89 is provided and has notches in the periphery thereof for engagement with a portion of a mandrel 6 to assure alignment of the mandrel 6 with the respective head 85.

Figure 9:
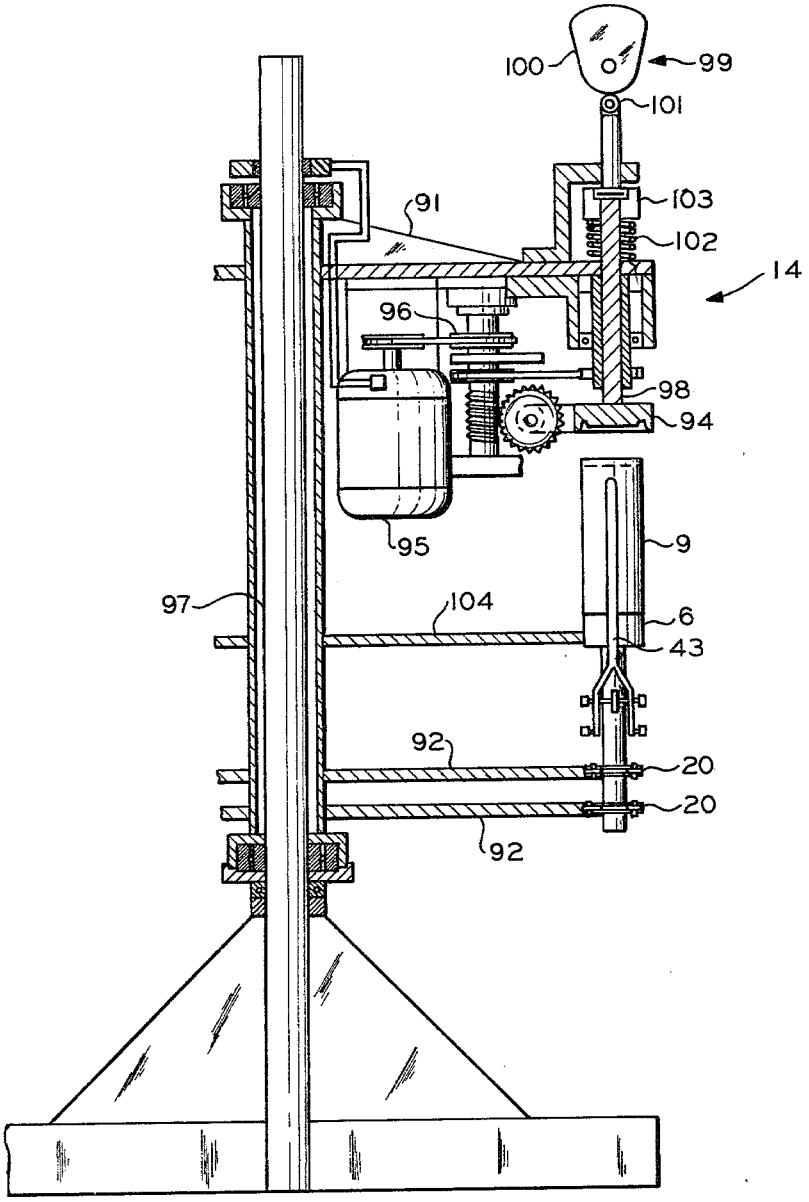
FIG. 9 is a fragmentary side elevational section view, as viewed from line 9—9, FIG. 1, of a portion of the bottom crimping means.

After leaving the heating means 11 the mandrels 6 carrying the wrapped sidewall blank and bottom closure members 61 are then conveyed by the conveyor 5 to a bottom forming station 14. The bottom forming station 14 is operable for urging engagement between the heated portions of the sidewall blank 9 and bottom closure member 61 for securing same together. A preferred form of bottom forming station is best seen in FIG. 9. In a preferred embodiment of the present invention, the bottom forming means 14 includes a turret 91 rotatably mounted on a shaft 97. The turret 91 is rotatable in synchronization with movement of the conveyor 5 and the mandrels 6. As shown, the synchronous movement is accomplished by having the turret 91 operably connected to the conveyor 5 via sprockets 92 each engagable with a respective chain 20. The turret 91 has a plurality of forming means mounted thereon each adapted to perform a forming operation on the bottom closure member and a portion of the sidewall. Such forming can be reverse bending of a portion of the sidewall 9' to overlap the skirt 78 on both sides of the skirt 78. This includes a plurality of forming heads 94 rotatably mounted on the turret 91. Motive means is operably connected to each of the heads 94 to effect rotation thereof. In the illustrated structure the motive means includes a motor 95 which, in a preferred form, is connected to a plurality of forming heads 94 via drive means 96 such as belts and pulleys. The motor 95 and drive means 96 are mounted on the turret 91 and rotate therewith about the shaft 97. The heads 94 are each mounted on a respective shaft 98 which is reciprocal for movement of the head 94 toward and away from the respective mandrels 6. Means is provided for sequentially effecting the reciprocal movement of the forming heads 94. The means for effecting reciprocal movement include a cam means 99 which includes a cam 100 which is selectively rotatable by drive means (not shown) which operably connect the cam 100 to the motor 95 whereupon during rotation of the cam the cam 100 engages a follower 101. The cam 100 is contoured so that during rotation it engages the follower 101 and urges the forming head 94 to move toward the respective mandrel 6. At a predetermined position of the cam, the contour changes such that the head 94 can move upwardly. A return spring 102 is provided and is in engagement with the turret 91 and a stop 103 to bias the forming head 94 to an up position away from the respective mandrel 6.

Means is provided for indexing or positioning the forming head 94 in alignment with the respective mandrel 6. Any suitable indexing means can be used and, as shown, a star wheel 104, having a plurality of notches therearound, is positioned so as to receive a respective mandrel within a respective notch thereby accurately positioning a mandrel 6 to a respective forming head 94.

Figure 10:
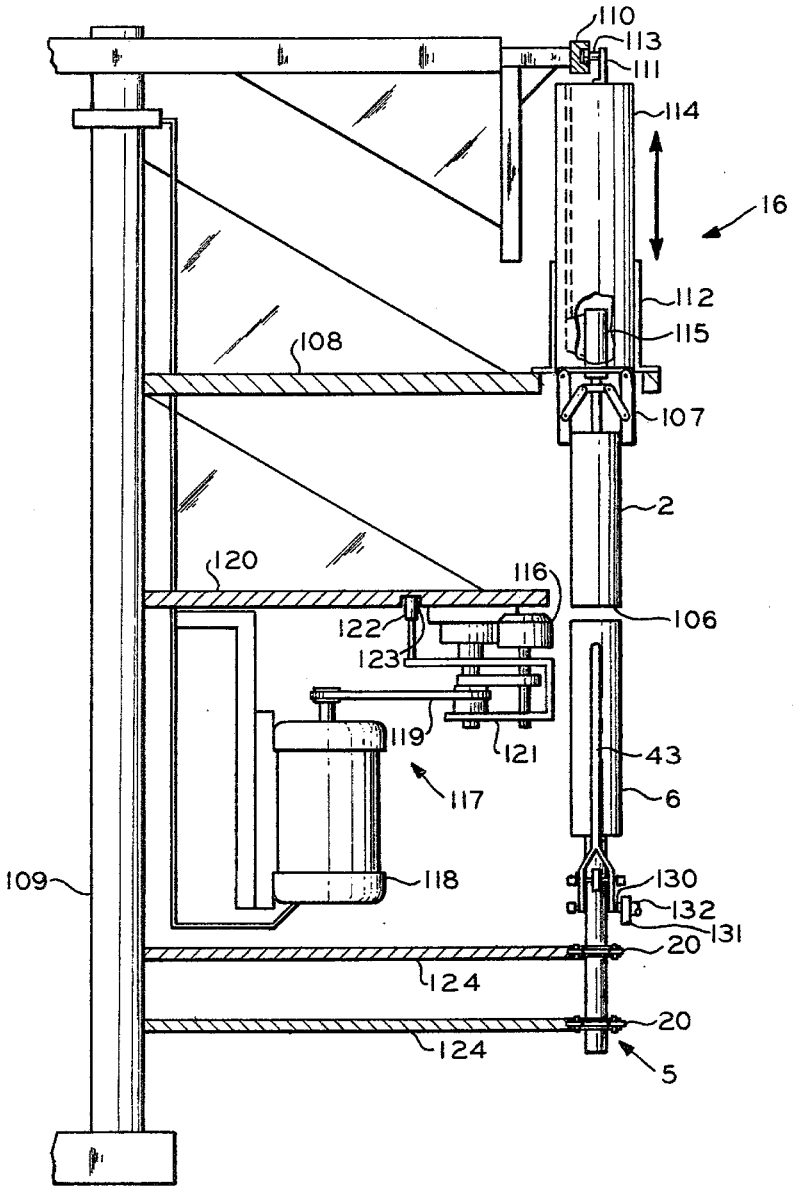
FIG. 10 is a fragmentary side elevational section view, as viewed along line 10—10, FIG. 1, of a portion of the container finishing means.

The finishing station 16 is best seen in FIG. 10. In the illustrated structure the station 16 includes means for performing a finishing operation on an open end of the container as, for example, flaring of the open end 106. The station 16 includes means for unlatching clamp arm 43 and removing a container 2 from a respective mandrel 6. Unlatching is accomplished by the movement of conveyor 5 bringing pin 130 of arm 45 against cam 131 positioned to cause the clamp arm 43 to move outward. Cam 131 is carried on a portion of the machine frame 132.

As shown, the removing means includes a pair of gripping arms 107 which are mounted on a turret 108. The turret 108 is rotatable about a shaft 109 in synchronization with movement of the conveyor 5 and mandrel 6. The arms 107 are mounted on means which effects reciprocating movement toward and away from the mandrel 6. This movement effecting means includes, in the illustrated structure, a groove type cylindrical cam 110 which is stationary relative to the turret 108. A bracket 111 is attached to a cylinder 114 reciprocally mounted in a guide 112. The bracket 111 has a cam follower 113 thereon receivable within the cam groove 110. The cam 110 is contoured such that during rotation of the turret 108 the reciprocating movement of the cylinder 114 is effected, and, hence, the arms 107 mounted thereon. The arms 107 are pivotally mounted on the cylinder 114 so as to be selectively movable into and out of engagement with a respective container 2. To effect the sequential gripping engagement a pneumatic ram 115 is operably connected to the arms 107 and by extension and retraction of the ram pivoting movement of the arms is effected and thereby opening and closing movement of the arms into and out of gripping engagement with the container 2. Gripping and release movement of the gripping arms 107 can be accomplished by a pneumatic switch operably connected in the air supply lines to and from the arm 115. Actuating elements (not shown) of any suitable type open and close the switches to effect operation of the gripping arms 107.

The finishing station is provided with means for effecting a finishing operation on the open end 106 and as shown the means includes means for flaring of the open end. As shown, the flaring means includes a plurality of flaring mandrels 116, each rotatably carried by the turret 108. Each flaring mandrel 116 is operably connected to drive means 117 such as an electric motor 118, via a series of belts and pulleys 119 or other suitable means. The belts and pulleys 110 can be arranged so as to drive each of the flaring mandrels 116, one flaring mandrel 116 for each of the plurality of gripping means, thereby reducing the number of motors needed for driving the flaring mandrels 116.

Means is provided for sequentially effecting movement of the flaring tools to a position immediately beneath a respective open end 106 and in axial alignment with the container 2. In the illustrated structure, the means includes a grooved cam plate 120 which is stationary, i.e., does not rotate with the turret 108. Each of the flaring mandrels 116 is mounted on a pivotably mounted arm 121 which has a cam follower mounted thereon operable for following the contour of the cam 120. The follower 122 by virtue of following the contour of the groove 123 in cam plate 120 effects pivoting movement of the respective arm 121 and hence movement of the flaring mandrel to a position beneath the open end of the container 106 after same moves out of axial alignment with the respective mandrel 6. After the flaring mandrel 116 has moved to a position beneath the open end 106, the cam 110 in cooperation with the follower 113 and shaft 111 effects downward movement of the container 2 onto the flaring mandrel 116 which during engagement and rotation effects flaring of the open end 106. Preferably, movement of the turret 108 is synchronized with movement of the conveyor 5 and mandrels 6 such as by having the shaft 109 operably connected to the conveyor 5 via a pair of sprockets 124 each in engagement with a respective chain 20.

Conveying or carrying means 126 is provided adjacent the finishing station 16 and is operable for receiving finished containers 2 released from the gripping arms 107. The conveyor 126 then conveys the finished containers to a point of use, storage or the like.

The conveyor 5 can be driven by any suitable means and as shown a star wheel 128, which has a pair of sprockets mounted on a common shaft, is operably connected to suitable drive means (not shown) for effecting rotation of the star wheel 128 and respective drive sprockets to effect movement of the conveyor. The star wheel 128 also serves a function of allowing the conveyor 5 to move around a corner in the defined path.

It is to be understood that while there has been illustrated and described certain forms of this invention, it is not to be limited to the specific form or arrangement of parts herein described and shown except to the extent that such limitations are found in the claims.

What is claimed and desired to be secured by Letters Patent is:

1. A method of forming a container, said method including:

sequentially feeding individual sidewall blanks having side marginal portions from a storage magazine to a pickup station adjacent a circuitous path defined by a continuously moving endless conveyor carrying a plurality of mandrels;

heating said side marginal portions of said sidewall blanks during said feeding step;

sequentially moving each of the mandrels into engagement with a respective sidewall blank at the pickup station;

partially wrapping a thus engaged sidewall blank about the respective mandrel;

completely wrapping a thus partially wrapped sidewall blank about the respective mandrel with continuously moving wrapping wing means and overlapping said side marginal portions of the sidewall blank;

bonding together the thus overlapped side marginal portions forming an open ended tubular sidewall;

sequentially forming a plurality of end closure members by a respective one of a plurality of first means carried on a continuously rotating first turret;

sequentially inserting each thus formed end closure member into an open end of a respective thus formed tubular sidewall during continuous movement of the respective mandrel along the defined path;

heating at least portions of the tubular sidewalls and respective end closure members, wherein said heated portions of the tubular sidewall and end closure members are sequentially heated by a respective one of a plurality of second means carried on a continuously rotating second turret;

sequentially bonding the thus inserted and heated end closure members to the respective heated tubular sidewalls to form containers;

sequentially removing each of the thus formed containers from the respective mandrel; and sequentially returning each of the thus emptied mandrels to the pickup station for engagement with another respective sidewall blank.

2. A method as set forth in claim 1 including:

sequentially reverse bending a portion of each of the sidewalls thereby urging engagement of the thus reverse bent portions with a skirt portion of a said respective end closure member; and wherein said sidewall portions are reverse bent by a respective one of a plurality of third means carried on a continuously rotating third turret.

3. A method as set forth in claim 2 including:

sequentially finishing an open end of each of the containers after removal from the respective mandrel; and wherein said containers are finished by a respective one of a plurality of fourth means carried on a continuously rotating fourth turret.

4. An apparatus for manufacturing containers having a tubular sidewall and an end enclosure, said apparatus including:

an endless conveyor continuously movable along a defined path;

a plurality of mandrels mounted on said conveyor and movable thereby along the defined path;

first means adjacent said conveyor operable for sequentially feeding a sidewall blank having opposite side marginal portions to each of said mandrels as the respective mandrel passes thereby, said first means including heating means operable for heating the side marginal portions of a sidewall blank before the thus heated sidewall blank is fed to a respective mandrel;

a plurality of clamp means, each clamp means being associated with a respective mandrel and being operable for holding a sidewall blank in engagement with the respective mandrel;

wrapping means adjacent said conveyor at a location downstream of said first means, operable for wrapping a thus engaged sidewall blank about the respective mandrel, said wrapping means including carrying means positioned adjacent said conveyor, said wrapping means having wrapping wing means associated therewith, said carrying means being operable for moving said wrapping wing means synchronously with a thus engaged mandrel as the thus engaged mandrel moves along a portion of said defined path during which movement the wrapping wing means effect wrapping of the respective sidewall blank about the respective mandrel to overlap and bond together the opposite side marginal portions of the sidewall blank, thereby forming a tubular sidewall, said carrying means including first and second conveying means positioned on opposite sides of said defined path and drive means operably connected to said first and second conveying means for effecting continuous movement thereof synchronously with movement of the conveyor; said conveyor, and said wrapping wing means including a plurality of first wrapping wings mounted on said first conveying means and a plurality of second wrapping wings mounted on said second conveying means, said first wrapping wings being operable for overlapping said marginal portions of the sidewall blank during wrapping and urging the thus overlapped side marginal portions into engagement for securing the side marginal portions together;

second means adjacent said conveyor at a location downstream of said wrapping means, operable for inserting an end closure member into an open end of the thus formed tubular sidewall;

third means adjacent said conveyor at a location downstream of said second means, operable for heating a portion of the thus associated tubular sidewall and end closure member;

fourth means positioned adjacent said conveyor at a location downstream of said third means, operable for bonding together the thus heated tubular sidewall and associated end closure member to form a container;

fifth means positioned adjacent the conveyor at a location downstream of said fourth means, operable for performing a finishing operation on the open end of the thus formed container; and sixth means operable for removing the thus finished container from said fifth means after the finishing operation.

5. An apparatus as set forth in claim 4 wherein said fourth means includes:

rotatable turret;

a plurality of forming heads rotatably mounted on said turret;

drive means operably connected to said forming heads and operable for effecting rotation of said forming heads;

means for sequentially effecting reciprocal movement of each of the forming heads toward and away from a respective mandrel; and positioning means operable for positioning the mandrels in alignment with a respective forming head.

6. An apparatus as set forth in claim 5 wherein:

said forming heads are each mounted on a respective shaft which are mounted on said turret for both rotational and axial reciprocal movement; and said means for sequentially effecting reciprocal movement includes a plurality of cam means each operably associated with a respective said shaft.

7. An apparatus as set forth in claim 4 wherein said fifth means includes:

rotatable turret;

a plurality of gripping means carried by said turret and operable for gripping a container while on a respective mandrel and removing said respective container from said respective mandrel; and a plurality of finishing means mounted on said turret each adjacent a respective said gripping means operable for a finishing operation on an open end of said container.

8. An apparatus as set forth in claim 7 wherein said fifth means includes:

cam means operable for selectively moving said finishing means toward and away from a finishing position; and means cooperating with said gripping means operable for selectively moving the gripping means and a gripped container toward and away from the finishing means in its finishing position.

9. An apparatus as set forth in claim 8 wherein each said finishing means includes:

a flaring mandrel rotatably carried by said turret; and drive means operably connected to each said flaring mandrel for effecting rotation thereof.

10. An apparatus as set forth in claim 8 wherein said sixth means includes:

a second conveyor adjacent said turret operable for receiving a container after release from said gripping means.

11. An apparatus as set forth in claim 4 wherein said first means includes:

a storage magazine adapted for storing a plurality of sidewall blanks; and second conveying means operable for receiving sidewall blanks from the storage magazine and conveying the sidewall blanks to a station where a sidewall blank is individually fed to a respective said mandrel.

12. An apparatus as set forth in claim 4 wherein said second means includes:

a first turret means having a rotatable portion;

a plurality of forming dies movably mounted in the rotatable portion of said first turret means;

cam means operable for selectively effecting movement of said forming dies between an end closure blank pickup position and an end closure member dispensing position;

storage means mounted on said first turret means and adapted for storage of a plurality of end closure blanks for sequential feeding to said forming dies;

a forming means adjacent each of said forming dies and operable for selectively forming an end closure member by forcing an end closure blank through a respective one of said forming dies; and positioning means operable for positioning said forming dies into alignment with respective said mandrels for receipt of a respective formed end closure member, movement of said forming dies when in said end closure member dispensing position being synchronized with movement of respective mandrels along the defined path.

13. An apparatus as set forth in claim 12 wherein said third means includes:

a second rotatable turret means;

a plurality of heads mounted on said second turret means and movable synchronously with respective mandrels, with each of said plurality of heads being adjacent a respective mandrel and operable for directing heat in a manner to heat a portion of the tubular sidewall and a portion of the end closure member;

heat supply means operably associated with said heads;

positioning means operable for positioning each of the heads at a heating position relative to the respective said mandrel.

14. An apparatus as set forth in claim 13 wherein said fourth means includes:

a third rotatable turret;

a plurality of forming heads rotatably mounted on said third turret;

drive means operably connected to said forming heads and operable for effecting rotation of said forming heads;

means for sequentially effecting reciprocal movement of each of the forming heads toward and away from a respective mandrel; and positioning means operable for positioning the mandrels in alignment with a respective forming head.

15. An apparatus as set forth in claim 14 wherein said fifth means includes:

a fourth rotatable turret;

a plurality of gripping means carried by said fourth turret and operable for gripping a container while on a respective mandrel and remove said respective container from said respective mandrel; and a plurality of finishing means mounted on said fourth turret each adjacent a respective said gripping means operable for a finishing operation on an open end of said container.

16. An apparatus as set forth in claim 15 wherein said sixth means includes:

a second conveyor adjacent said turret operable for receiving a container after release from said gripping means.

17. An apparatus as set forth in claim 4 wherein said second means includes:

a first turret means having a rotatable portion;

a plurality of forming dies movably mounted in the rotatable portion of said first turret means;

cam means operable for selectively effecting movement of said forming dies between an end closure blank pickup position and an end closure member dispensing position;

storage means mounted on said first turret means and adapted for storage of a plurality of end closure blanks for sequential feeding to said forming dies;

a forming means adjacent each of said forming dies and operable for selectively forming an end closure member by forcing an end closure blank through a respective one of said forming dies; and positioning means operable for positioning said forming dies into alignment with respective said mandrels for receipt of a respective formed end closure member, movement of said forming dies when in said end closure member dispensing position being synchronized with movement of respective mandrels along the defined path.

18. An apparatus as set forth in claim 17 wherein said third means includes:

a second rotatable turret means;

a plurality of heads mounted on said second turret means and movable synchronously with respective mandrels, with each of said plurality of heads being adjacent a respective mandrel and operable for directing heat in a manner to heat a portion of the tubular sidewall and a portion of the end closure member;

heat supply means operably associated with said heads;

positioning means operable for positioning each of the heads at a heating position relative to the respective said mandrel.

19. An apparatus as set forth in claim 18 wherein said fourth means includes:

a third rotatable turret;

a plurality of forming heads rotatably mounted on said third turret;

drive means operably connected to said forming heads and operable for effecting rotation of said forming heads;

means for sequentially effecting reciprocal movement of each of the forming heads toward and away from a respective mandrel; and positioning means operable for positioning the mandrels in alignment with a respective forming head.

20. An apparatus as set forth in claim 19 wherein said fifth means includes:

a fourth rotatable turret;

a plurality of gripping means carried by said fourth turret and operable for gripping a container while on a respective mandrel and remove said respective container from said respective mandrel; and a plurality of finishing means mounted on said fourth turret each adjacent a respective said gripping means operable for a finishing operation on an open end of said container.

21. An apparatus as set forth in claim 20 wherein said sixth means includes:

a second conveyor adjacent said turret operable for receiving a container after release from said gripping means.

22. An apparatus as set forth in claim 4 wherein said third means includes:

rotatable turret means;

a plurality of heads mounted on said turret means and movable synchronously with respective mandrels, with each of said plurality of heads being adjacent a respective mandrel and operable for directing heat in a manner to heat a portion of the tubular sidewall and a portion of the end closure member;

heat supply means operably associated with said heads;

positioning means operable for positioning each of the heads at a heating position relative to the respective said mandrel.

23. A method of forming a container, said method including:

sequentially feeding individual sidewall blanks having side marginal portions from a storage magazine to a pickup station adjacent a circuitous path defined by a continuously moving endless conveyor carrying a plurality of mandrels;

sequentially moving each of the mandrels into engagement with a respective sidewall blank at the pickup station;

partially wrapping a thus engaged sidewall blank about the respective mandrel;

completely wrapping a thus partially wrapped sidewall blank about the respective mandrel with continuously moving wrapping wing means and overlapping said side marginal portions of the sidewall blank;

bonding together the thus overlapped side marginal portions forming an open ended tubular sidewall;

sequentially forming a plurality of end closure members;

sequentially inserting a thus formed end closure member into an open end of a respective thus formed tubular sidewall during continuous movement of the respective mandrel along the defined path;

sequentially heating portions of the tubular sidewalls and respective end closure members by means of a respective one of a plurality of heating means carried on a continuously rotating turret;

sequentially bonding the thus inserted end closure members to the respective tubular sidewalls to form containers;

sequentially removing each of the thus formed containers from the respective mandrel; and sequentially returning each of the thus emptied mandrels to the pickup station for engagement with another respective sidewall blank.

24. A method as set forth in claim 23 including:

heating the side marginal portions of the sidewall blanks during feeding and before bonding together.

25. A method of forming a container, said method including:

sequentially feeding individual sidewall blanks having side marginal portions from a storage magazine to a pickup station adjacent a circuitous path defined by a continuously moving endless conveyor carrying a plurality of mandrels;

sequentially moving each of the mandrels into engagement with a respective sidewall blank at the pickup station;

partially wrapping a thus engaged sidewall blank about the respective mandrel;

completely wrapping a thus partially wrapped sidewall blank about the respective mandrel with continuously moving wrapping wing means and overlapping said side marginal portions of the sidewall blank;

bonding together the thus overlapped side marginal portions forming an open ended tubular sidewall;

sequentially forming a plurality of end closure members;

sequentially inserting a thus formed end closure member into an open end of a respective thus formed tubular sidewall during continuous movement of the respective mandrel along the defined path;

sequentially reverse bending a portion of each of the tubular sidewalls thereby urging engagement of each of the thus reverse bent portions with a skirt portion of a respective end closure member inserted therein, each of said reverse bent portions being reverse bent by a respective one of a plurality of reverse bending means carried on a continuously rotating turret;

sequentially bonding the thus inserted end closure members to the respective tubular sidewalls to form containers;

sequentially removing each of the thus formed containers from the respective mandrel; and sequentially returning each of the thus emptied mandrels to the pickup station for engagement with another respective sidewall blank.

26. A method of forming a container, said method including:

sequentially feeding individual sidewall blanks having side marginal portions from a storage magazine to a pickup station adjacent a circuitous path defined by a continuously moving endless conveyor carrying a plurality of mandrels;

sequentially moving each of the mandrels into engagement with a respective sidewall blank at the pickup station;

partially wrapping a thus engaged sidewall blank about the respective mandrel;

completely wrapping a thus partially wrapped sidewall blank about the respective mandrel with continuously moving wrapping wing means and overlapping said side marginal portions of the sidewall blank;

bonding together the thus overlapped side marginal portions forming an open ended tubular sidewall;

sequentially forming a plurality of end closure members;

sequentially inserting a thus formed end closure member into an open end of a respective thus formed tubular sidewall during continuous movement of the respective mandrel along the defined path;

sequentially bonding the thus inserted end closure members to the respective tubular sidewalls to form containers;

sequentially removing each of the thus formed containers from the respective mandrel;

sequentially finishing an open end of each of the containers after removal from the respective mandrel, each of said containers being finished by a respective one of a plurality of finishing means carried on a continuously rotating turret; and sequentially returning each of the thus emptied mandrels to the pickup station for engagement with another respective sidewall blank.

27. A method as set forth in claim 23 or claim 25 wherein:

said end closure members are sequentially formed by respective ones of a plurality of forming means carried on a continuously rotating second turret.

28. A method as set forth in claim 23 or claim 25 including:

sequentially finishing an open end of each of the containers after removal from the respective mandrel, each of said containers being finished by a respective one of a plurality of finishing means carried on a continuously rotating second turret.

29. A method as set forth in claim 23 or claim 26 including:

sequentially reverse bending a portion of each of the tubular sidewalls thereby urging engagement of each of the reverse bent portions with a skirt portion of a respective end closure member inserted therein, each of said reverse bent portions being reverse bent by a respective one of a plurality of reverse bending means carried on a continuously rotating second turret.

30. A method as set forth in claim 25 or claim 26 including:

heating the side marginal portions of the sidewall blanks during feeding and before bonding together; and heating portions of the tubular sidewalls and respective end closure members before bonding together.

31. A method as set forth in claim 25 or claim 26 including:

sequentially heating portions of the tubular sidewalls and respective end closure members by means of respective ones of a plurality of heating means carried on a continuously rotating second turret.

32. A method as set forth in claim 26 wherein:

said end closure members are sequentially formed by respective ones of a plurality of forming means carried on a continuously rotating second turret.

* * * * *